US005150724A

United States Patent [19]

Liu

[11] Patent Number: 5,150,724

[45] Date of Patent: Sep. 29, 1992

[54] METHOD OF MAKING NON-NICOTINE CIGARETTES

[76] Inventor: Chien-Ching Liu, No. 103, Yi Hua St., Taichung, Taiwan

[21] Appl. No.: 672,565

[22] Filed: Mar. 20, 1991

[51] Int. Cl.[5] ..... A24B 15/00

[52] U.S. Cl. ..... 131/359; 131/369

[58] Field of Search ..... 131/359, 369

[56] References Cited

U.S. PATENT DOCUMENTS

| | | | |
|---|---|---|---|
| 2,943,959 | 7/1960 | Schaflander | 131/359 |
| 3,034,931 | 5/1952 | Kiefer | 131/359 |
| 3,369,551 | 2/1968 | Carroll | 131/359 |
| 3,964,494 | 6/1976 | White | 131/359 |
| 3,964,495 | 6/1976 | White | 131/359 |
| 3,964,496 | 6/1976 | White | 131/359 |
| 3,964,497 | 6/1976 | White | 131/359 |
| 3,964,498 | 6/1976 | White | 131/359 |
| 3,977,412 | 8/1976 | White | 131/359 |
| 3,977,413 | 8/1976 | White | 131/359 |
| 3,977,414 | 8/1976 | White | 131/359 |
| 3,977,415 | 8/1976 | White | 131/359 |
| 3,978,866 | 9/1976 | Cook | 131/359 |
| 4,165,752 | 8/1979 | Bustamante | 131/359 |
| 4,201,228 | 5/1980 | Lewinger | 131/359 |
| 4,700,727 | 10/1987 | Torigian | 131/359 |
| 4,813,438 | 3/1989 | Fleming | 131/359 |
| 4,969,477 | 11/1990 | Yagisawa | 131/359 |

FOREIGN PATENT DOCUMENTS

| | | | |
|---|---|---|---|
| 1184756 | 4/1985 | Canada | 131/359 |

*Primary Examiner*—V. Millin
*Assistant Examiner*—Lynne A. Reichard
*Attorney, Agent, or Firm*—Bacon & Thomas

[57] ABSTRACT

The present invention provides a method for making cigarettes with the stems and leaves of fennel and/or *foeniculum vulgare* in place of tobacco in order to provide a nicotine-free cigarette. Cigarettes made in accordance with this invention minimize the harm to smokers and allow smokers to maintain their health. To produce the cigarettes, fennel and/or *foeniculum vulgare* may be mixed together or used alone, based on the availability of either plant. The process of making cigarettes from these ingredients is simplified due to differences in the nature and form of the *foeniculum vulgare* and fennel. The process for making cigarettes of the present invention is simplified and is less costly in comparison to making cigarettes from tobacco. The present invention is beneficial to both smokers and manufacturers.

5 Claims, 1 Drawing Sheet

METHOD OF MAKING NON-NICOTINE CIGARETTES

BACKGROUND OF THE INVENTION

The present invention relates to a new type of cigarette filler which does not contain any toxic nicotine. The filler, being made with the stems and leaves of fennel and/or *foeniculum vulgare*, such as Asiatic *foeniculum vulgare*, do not contain any toxic nicotine. Cigarettes made in accordance with this invention are not only harmless to habitual smokers, but they are also enjoyable and provide a refreshing feeling.

Cigarettes made from tobacco contain nicotine and such cigarettes when lighted and smoked, are deleterious to the health of smokers. The harmful nature of nicotine containing cigarettes is universally known. In fact, it was even known and written about by the ancient Chinese. For example, in the collection of words, book II, it says on page 2,470, "Yen Chien or Yen Tsao Su" is a chemical term for a type of alkaloid. In English it is called nicotine. Nicotine exists in tobacco in formation with malic acid or citric acid. It is a colorless, oily liquid which contains no oxide. It is volatile and water soluble. It smells like tobacco and becomes brown when exposed to air. It is a strong poison; since two or three drops would be fatal for humans. Even a small amount in the lungs causes drowsiness, headache and dizziness. Excessive long term smoking causes clumsiness and stomach and eye disorders.

Nicotine has been implicated as a carcinogenic substance by many cancer research organizations throughout the world. For example, in the 1978 and 1982 Journals of the International Agency for Research on Cancer (IARC) it is said that nicotine is a major factor in the cause of cancer.

People have smoked tobacco for a long time. Many people enjoy smoking at the present time and many people have died as result of lung cancer caused by nicotine. It has been reported that it is 6 to 10 times more likely for smokers to die from lung cancer than for non-smokers. Smoking prohibitions have been initiated everywhere and there is a widespread anti-smoking campaign. Although such prohibitions and campaigns may have some degree of effectiveness, it is not the best way to solve the problem. The population of smokers is increasing. Children may start to smoke as early as 11 or 12 years old. Clearly, the initiation of smoking at such a young age will have a deleterious effect on their health. It is therefore highly desirable to remove nicotine from cigarettes. Therefore, the inventor has spend many years to develop a new method to make cigarettes so that manufacturers can produce nicotine free and non-toxic cigarettes.

SUMMARY OF THE INVENTION

In the present invention the nicotine is removed from the cigarettes by replacing the tobacco with fennel or *foeniculum vulgare*. Cigarettes made with these nicotine-free and aromatic plants lessen the possibility of harm to smokers. In addition, the smoking of cigarettes made in accordance with this invention can make smokers refreshed, composed and enjoyable, meditative, inspired and solid looking.

The present invention has the following advantages.

1. The form, appearance, size and taste of the cigarettes of the present invention will be the same as conventional cigarettes. Thus, smokers will experience the same sensation in their mouth and the similar feeling of touch when smoking the cigarettes of the present invention. People who have been smoking for a long time will enjoy smoking the cigarettes of the present invention because these cigarettes have the same characteristics as those made with tobacco. New smokers will feel good and smell no tar.

2. Manufacturers may produce the cigarettes of the present invention on a conventional production line without the need to alter the equipment. It will not be necessary to train new workers and thus, the cost will be lowered.

3. People will not become addicted to smoking the cigarettes of this invention. They will be able to control themselves and not develop a habit. Therefore, it will be easy for them to stop smoking immediately. In contrast, if tobacco smoking becomes habitual, it is very difficult to quit.

DESCRIPTION OF THE PREFERRED EMBODIMENT

Figure 1:
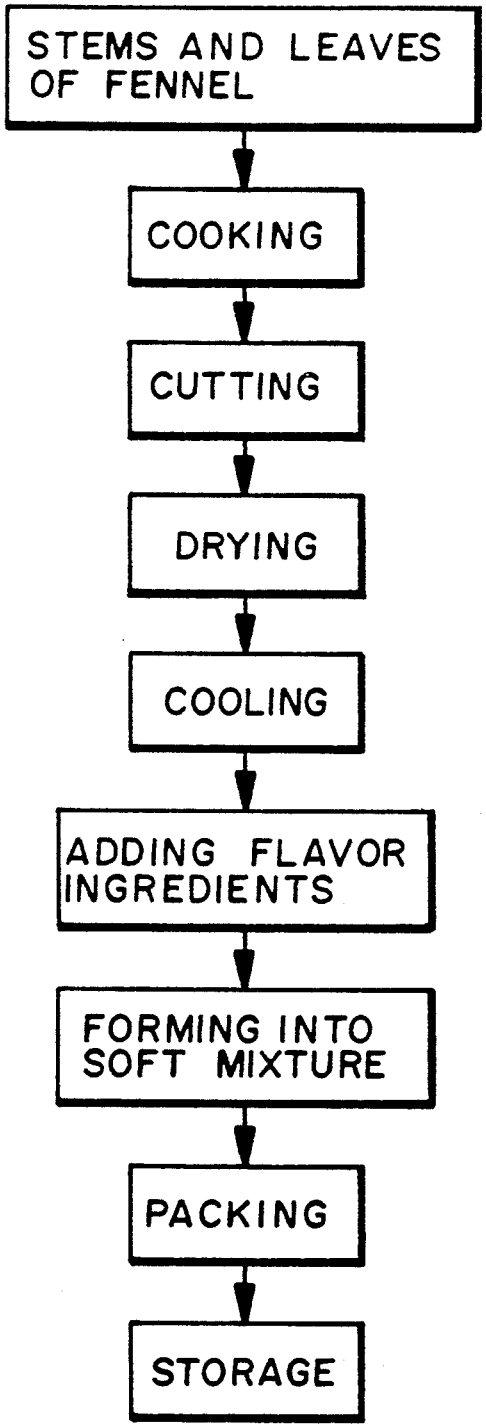
FIG. 1 is a flow sheet which depicts the process of the present invention.

The ingredients of foeniculum vulgare are listed below in order to facilitate an understanding of the cigarette filler used in the present invention.

| | |
|---|---|
| Moisture | 90.8% |
| Protein | 3.0% |
| Fat | 0.4% |
| Ash | 1.5% |
| Fiber | 1.5% |
| N-free Ext | 2.8% |

The medicinal substances in *foeniculum vulgare* include:

| |
|---|
| Ascorbic acid (123 mg %) |
| Dehydre-ascorbic acid (37 mg %) |
| little bit of vitamin B2 |
| Nelumboside |
| Foeniculin |
| Kaempferol-3-glucuronide |
| Quercetin-3-glucuronide |
| Cinnanmic acid |
| Ferulic acid |
| Caffeic acid |
| Benzoic acid |
| Anisic acid |
| Vanillic acid |
| Gentisic acid |
| O-Conmaric acid |
| Protocatechuic acid |
| Syringic acid |
| Sinapic acid |
| Fumaric acid |
| Malic acid |
| Tartaric acid |
| Citric acid |
| Shikimic acid |
| Quinic acid |

Cigarettes made with plants which include the above mentioned ingredients can meet the need for those who cannot quit smoking. The cigarettes of the present invention will cause little harm to smokers, especially to second-hand smokers. Clearly, it is a good alternative to replace the regular cigarette with one which does not contain nicotine.

It should be emphasized that it takes a long time and a great deal of experimentation to determine that *foeniculum vulgare* or fennel is an acceptable replacement for tobacco to make a new cigarette filler. It is impossible to prohibit people from smoking. Therefore, it is clearly necessary to change the cigarette filler to make a new cigarette which lessens the harm to smokers and to people in the smoker's presence.

The inventor has taught in universities for many years. Fennel and 60 other kinds of novel fruits and vegetables have been successfully transplanted by him from other areas or countries to Taiwan. The fennel tastes sweet and its stems and leaves are the same as the stems and leaves of *foeniculum vulgare*. The stems and leaves of these two plants can be cut and used for cigarette filler. After harvesting, the young stems and leaves will be replaced by new growth. This cut and growth may be repeated many times in three to five years.

The stems and leaves of either of these two plants can be used alone as cigarette filler on the basis of their local production. It is unnecessary to mix these two materials together because the chemical constituents of each of them are the same.

Simply stated, the procedure for making cigarettes with tobacco leaves comprises 18 steps which are as follows:

1. Providing tobacco such as by purchasing.
2. Preparing the tobacco for the removal of stems.
3. Removing the stems.
4. Drying.
5. Laying the leaves.
6. Cooking by boiling.
7. Arranging the leaves.
8. Mixing by rearrangement.
9. Spreading out.
10. Forming the leaves into bails.
11. Cutting the leaves.
12. Drying.
13. Cooling.
14. Adding and combining the desired tobaccos.
15. Forming the cut tobacco into a loose and soft mixture.
16. Forming the cigarettes.
17. Packing the cigarettes.
18. Storing the cigarettes.

The leaves of the *foeniculum vulgare* are needle shaped. The stems, after drying, can also be used in the cigarette filler. In comparison with tobacco, *foeniculum vulgare* can be used to make cigarettes in a simple time-saving and cost-saving method.

The present invention simplifies the process of cigarette making into a 10 step procedure. The procedure is as follows:

1. Providing the stems of leaves of *foeniculum vulgare* (such as by purchasing said stems and leaves). The *foeniculum vulgare* can be cultivated by adding manufacturer or purchased from any farmer.
2. Cooking the stems and leaves by boiling particularly by sending steam through a vacuum to soften the stems an leaves.
3. Cutting the stems and leaves to facilitate the production of the cigarette.
4. Drying the steamed material.
5. Cooling the heated stems and leaves.
6. Adding and combining with the addition of a small amount of sugar and spice.
7. Forming the stems and leaves into a loose and soft mixture.
8. Producing rolled cigarettes.
9. Packing the cigarettes in boxes.
10. Storing the packed boxes for marketing.

In short, the use of *foeniculum vulgare* to make cigarettes saves much work and equipment and reduces the cost of cigarette making. Both manufacturers and smokers will benefit from this advantage.

I claim:

1. A method for making a non-nicotine cigarette which comprises the steps of: providing the stems and leaves of a non-nicotine containing plant selected from the group consisting of fennel and *foeniculum vulgare* and mixtures thereof; comminuting the stems and leaves; and forming the comminuted stems and leaves into a cigarette.

2. The method of claim 1 which further includes the step of cooking the stems and leaves by contacting said stems and leaves with boiling water or steam.

3. The method of claim 2 which further includes the step of cooling the stems and leaves after they have been cooked.

4. The method of claim 3 wherein the stems and leaves are obtained from *foeniculum vulgare*.

5. The method of claim 4 wherein the *foeniculum vulgare* grown in Asia.

* * * * *